United States Patent [19]

Morin

[11] 4,169,570

[45] Oct. 2, 1979

[54] EAVESTROUGH HANGER

[76] Inventor: Fernand R. Morin, 753 Cartier Dr., Windsor, Ontario, Canada, N9E 1N5

[21] Appl. No.: 945,236

[22] Filed: Sep. 25, 1978

[51] Int. Cl.[2] ..... E04D 13/06

[52] U.S. Cl. ..... 248/48.2; 52/16

[58] Field of Search ..... 248/48.1, 48.2; 52/94, 52/95, 96, 16

[56] References Cited

U.S. PATENT DOCUMENTS

| | | | |
|---|---|---|---|
| 472,294 | 4/1892 | Heartley | 248/48.1 |
| 1,867,121 | 7/1932 | Walten | 248/48.2 |
| 2,761,642 | 9/1956 | Rachlin | 248/48.1 |
| 2,895,694 | 7/1959 | Graving et al. | 248/48.1 |
| 2,928,634 | 3/1960 | Bender | 248/48.2 |
| 3,053,491 | 9/1962 | Ramser | 248/48.2 |
| 3,296,749 | 1/1964 | Cotter | 248/48.2 X |
| 3,344,562 | 10/1967 | Miles et al. | 52/96 X |
| 3,737,127 | 6/1973 | Maloney | 248/48.2 |
| 3,752,428 | 8/1973 | Trostle et al. | 248/48.2 |
| 4,000,587 | 1/1977 | Weber | 52/16 |

FOREIGN PATENT DOCUMENTS

| | | | |
|---|---|---|---|
| 654296 | 12/1962 | Canada | 248/48.2 |

*Primary Examiner*—J. Franklin Foss

*Attorney, Agent, or Firm*—Allen D. Gutchess, Jr.

[57] ABSTRACT

This invention consists of a hanger by means of which eavestroughing can be nailed to a building so that the nail is embedded into the wood framework of the building, at a downward angle, and so that the head of the nail is not visible on the front wall of the eavestroughing. The hanger is provided with a hook at its front end for attachment to the upper rim of the front wall of the eavestrough, and a plate at its rear end, which abuts the inside of the rear wall of the trough, when it is inserted therein. Starting from about half way of the hanger and running at a downwardly inclined angle to the rear wall is an open ended tube for holding and guiding a nail therein. The hanger and the tube are provided with attached strips for reinforcement.

10 Claims, 4 Drawing Figures

EAVESTROUGH HANGER

This invention consists of an eavestrough hanger used in the installation of eavestroughs, by means of which the eavestroughs are fastened to the building upon which they are installed.

The accepted method of attaching eavestroughing to buildings consists of nailing it to the wood framework of the building. The nails pass through the entire eavestrough, so that the larger diameter nail head, which does not add to the appearance of the trough, is always visible. Furthermore, the part of the nail, which is not embodied in the wood, is constantly exposed to the rusting effect of the weather, so that over a period of time the nail is entirely eaten away.

Due to the high cost of labor, many eavestrough contractors have turned to the use of mass production methods to reduce the cost of installation time on large scale operations. One such method consists of providing an extrusion machine on each of their personnel trucks, which turns out a required length of eavestroughing right on the job. This reduces the cost of fabrication; and in addition a special hanger had to be invented to further reduce the cost of installation.

Figure 1:
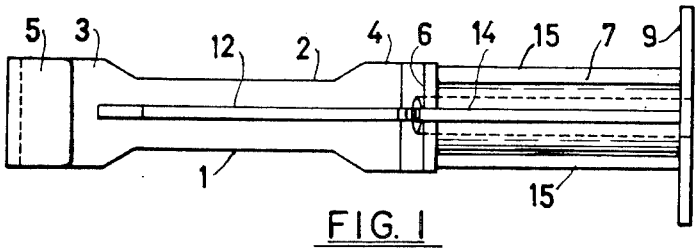
Figure 2:
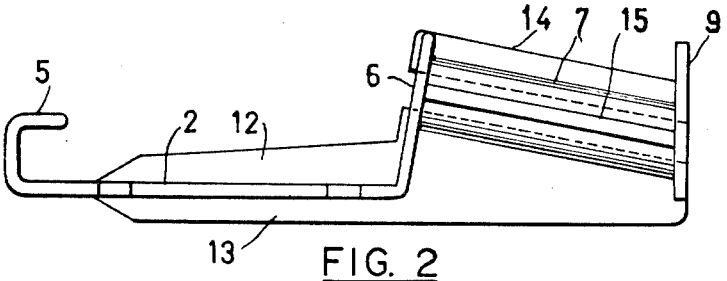
Figure 3:
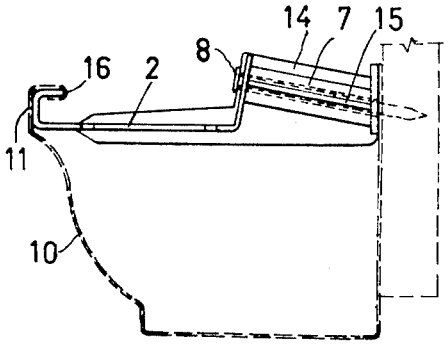
Figure 4:
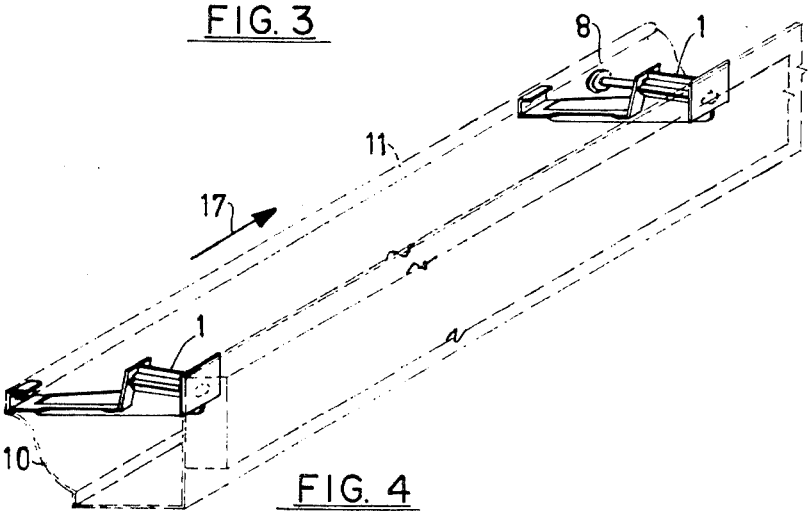

The above problems have been solved by this invention as will be seen in the following description and drawings in which, FIG. 1 is a plan view of a hanger in accordance with the invention, FIG. 2 is an elevational view of the hanger invention, FIG. 3 is a section through a standard type of eavestroughing with the hanger inserted therein, and FIG. 4 is a view in perspective of the hanger used for mass production installation.

The hanger 1, which is preferably made of a colorless, transparent, plastic material, consists of a flat strip 2, which is widened at each end thereof as shown by the front and 3, and the rear end 4. The widened front section 3 is bent upwardly into a rectangular hook 5, while the rear section 4 is bent upwardly at a slight angle to the vertical, it extends in height above the top of the hook 5 and will be referred to as the angled upright wall 6. Attached to the wall 6 and extending backwardly is an open ended tubular section 7 into which is inserted the nail 8 by means of which the trough is nailed into the building, the tube being inclined downwardly at a suitable angle. The rear end of the tube 7 is provided with a rectangular upright plate 9 which abuts the inside rear wall of the eavestrough 10 when the hook 5 is hooked into the front rim 11 of the said eavestrough.

Centrally located on the top and bottom of the plate 2 are vertical bracing plates or ribs 12 and 13, respectively. The top plate 12 starts just short of the hook 5 and terminates at the rear plate 6, and the bottom plate 13 starts at the same point as the plate 12 but extends the full length of the hanger to the plate 9. Thin reinforcement strips 14 and 15 reinforce the tube 7 on top and on its sides, respectively.

Normally, the installation of the eavestrough consists of delivering the prefabricated length of eavestroughing to the required location, lining up the trough in the right position along the rim of the building roof, and nailing the trough to the building framework. The nails penetrate the front and rear walls of the eavestrough, and are spaced fairly close to each other in order to provide long lasting security to the installation.

In using a rapid method of installation, which, in some cases, may reduce the installation time to about 25% percent of the time involved in the process described above, the installation consists of extruding the eavestrough directly on the service truck, and as it comes out of the extruding machine, one of the workers inserts the hangers into the eavestroughs, while another worker inserts the nails into the tubes 7 of the hangers. The eavestrough is then raised to the rim of the roof, and is immediately nailed in the required position. This process is to a certain extent illustrated in FIG. 4.

From FIGS. 3 and 4 it can be seen that, due to the particular structure of the hook 5, which fits snugly into the reentrant bend 16 of the eavestrough 10, the hanger 1 is held in position until the eavestrough is nailed to the building. This cannot be accomplished by any prefabricated hangers at present upon the market.

The advantages in using this invention can be numarized as follows:

(a) No nail heads are visible on the outside of the troughs; therefore, the installation has a better appearance, and nails do not have to be colored to match the color of the eavestrough, thereby reducing nail inventory.

(b) The hangers are easily inserted into the trough and held into position, properly spaced until nailed.

(c) The nail enters the building frame at an angle. It therefore provides a stronger hold, allowing the hangers to be spaced a greater distance apart, thereby reducing the number of hangers per installation.

(d) Due to the nails being totally enclosed in the hangers, no part of the nails is exposed to the action of weather conditions.

(e) The hanger being made of a plastic material, by injection moulding, is lighter in weight, considerably less costly than any metal hanger, and is weather resistant.

(f) The angular penetration of the nail into the supporting framework allows the trough to be installed higher into the roof edge without damaging the roof edge.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. An eavestrough hanger by means of which standard type eavestrough, equipped with a front rectangular upper rim which terminates into a horizontal reentrant edge, is attached to the wood frame of a building by means of nails; the said nails being lodged in the wood at a downward angle; the heads of said nails being invisible in the front of said eavestrough; and the bodies of said nails being shielded from the action of the elements; said hanger comprising a narrow horizontal strip which is widened at the front and rear ends thereof; the front widened area being bent into an upright rectangular hook consisting of a vertical wall which is in turn bent inwardly into a short horizontal section; said hook being of a dimension to fit snugly into, and be held by a front upper rim of the eavestrough; the horizontal strip at the rear widened area being bent upwardly into a wall which is at an angle to said strip; an open ended tube for holding a nail therein, which extends backwardly from the said angled wall, at a downward angle, and terminates at its other end into a vertical plate which abuts the inside rear wall of the eavestrough when inserted therein.

2. A hanger for eavestroughs as described in claim 1 which is made of plastic material.

3. A hanger for eavestroughs according to claim 1 characterized by said strip having a narrow vertical reinforcement bar on the upper surface thereof, which extends up the angled wall and terminates short of said rectangular hook.

4. Hanger for eavestroughs according to claim 1 characterized by said strip having a narrow vertical reinforcement bar on the lower surface thereof, which terminates short of said hook and extends to said vertical plate.

5. A hanger for an eavestrough according to claim 1 characterized by said tube having an upper vertical reinforcement bar which is centrally located thereon and extends the full length of said tube.

6. A hanger for an eavestrough according to claim 1 characterized by said tube having two reinforcement bars centrally located on opposite sides of said tube and extending the full length thereof.

7. An eavestrough hanger comprising a generally horizontal strip terminating at a front end in a generally rectangular hook of a dimension to fit snugly into and be held by a generally rectangular upper rim of the eavestrough, a rear end of said strip being structurally integral with a generally upright wall, an open-ended tube affixed to said upright wall and extending therefrom on the side thereof opposite said strip at a downward angle, a substantially vertical plate affixed to the end of said tube spaced from said upright wall, said upright wall and said vertical wall having openings communicating with the open-ended tube.

8. An eavestrough hanger according to claim 7 characterized by said hanger being made of plastic material.

9. An eavestrough hanger according to claim 7 characterized by said strip having a narrow vertical reinforcement bar thereon terminating short of said hook and extending to said upright wall.

10. An eavestrough hanger according to claim 7 characterized by said strip having a reinforcement bar on the lower surface thereof, said bar terminating short of said hook and extending at least to said tube.

* * * * *